United States Patent [19]

Stephens

[11] Patent Number: 4,771,574

[45] Date of Patent: Sep. 20, 1988

[54] QUICK RELEASE BURGLAR BAR

[76] Inventor: Lukie Stephens, 36 Blackwell St., Ft. Rucker, Ala. 36362

[21] Appl. No.: 9,490

[22] Filed: Feb. 2, 1987

[51] Int. Cl.[4] ..... E05B 65/10

[52] U.S. Cl. ..... 49/141; 49/56; 292/150; 292/162; 292/175; 292/302

[58] Field of Search ..... 49/141, 56, 57, 50; 292/302, 156, 162, 175, 150

[56] References Cited

U.S. PATENT DOCUMENTS

| | | | |
|---|---|---|---|
| 459,676 | 9/1891 | Daniel | 292/156 |
| 1,794,643 | 3/1931 | Raw | 292/175 |
| 4,019,281 | 4/1977 | Weiler | 49/141 X |
| 4,055,360 | 10/1977 | Russi | 49/141 X |
| 4,070,048 | 1/1978 | Young | 49/141 X |
| 4,073,525 | 2/1978 | Gurule | 292/150 X |
| 4,258,504 | 3/1981 | Hicks | 49/56 |
| 4,263,747 | 4/1981 | Coltrin | 49/141 X |
| 4,452,011 | 6/1984 | Trombettas | 49/56 |
| 4,631,862 | 12/1986 | Gallardo | 49/56 |

*Primary Examiner*—Philip C. Kannan
*Attorney, Agent, or Firm*—Leon Gilden

[57] ABSTRACT

A burglar bar assembly mountable over a window or door opening in a building may be quickly manually released from an interior portion of the building. The manual release mechanism is actuatable without a need for keys, or the like, so as to allow a building occupant to escape through the window or door opening in an emergency situation.

2 Claims, 2 Drawing Sheets

QUICK RELEASE BURGLAR BAR

BACKGROUND OF THE INVENTION

1. Field of the Invention

The present invention relates to burglar bars mountable over window and door openings in buildings, and more particularly pertains to a new and improved burglar bar assembly which may be quickly manually released from an interior portion of a building without the necessity of utilizing keys to effect such release.

2. Description of the Prior Art

The use of quick release guards on door and window openings is known in the prior art. For example, U.S. Pat. No. 4,019,281, which issued to R. Weiler on Apr. 26, 1977, discloses a quick release window guard essentially comprising an exteriorly mounted steel grating. The grating includes the use of metal bars which are bent rearwardly and which are secured to a building so that the grating overlies a window opening to thus protect against illegal building entry. The grating is hingedly connected to the building, and a hidden lock mechanism actuated by a cable may be operated to effect an opening of the grating to thus permit a rapid egress from the building through the window. As will be noted when reviewing this patent however, the construction of the hidden lock mechanism is essentially complex and requires its positioning within cross bars forming a part of the grating. Additionally, a hidden internal cable directed through such cross bars results in the construction of a grate assembly requiring a substantial expense of manufacture.

Another patent of interest relating to releasable window guards is U.S. Pat. No. 4,070,048, which issued to T. Young on Jan. 24, 1978. The Young device comprises a protective guard for ground floor windows of a dwelling and essentially consists of a metallic grid network releasably secured to an exterior edge of a window frame. A pull-out pin installed on an interior end of a bolt is held in position by a compressed, helical spring situated between the frame and pin. The pin may be forcibly urged out of engagement by the spring, thus to effect a release of the bolt that then results in the window guard being easily removed from the window opening. While this patent discloses a guard which is functional for its intended purpose, it will be noted that the design of the release mechanism is essentially complex and specialized, thus to result in an expense of manufacture which is prohibitive.

Accordingly, it can be appreciated that there is a continuing need for new and improved quickly releasable window and door guards which are of a simple and inexpensive design while being efficiently and reliably operable. In this respect, the present invention substantially fulfills this need.

SUMMARY OF THE INVENTION

In view of the foregoing disadvantages inherent in the known types of quick release window and door guards now present in the prior art, the present invention provides an improved quick release window and door guard which may be easily and inexpensively manufactured and installed, and which is operably releasable from an interior portion of a building without the need for or use of specialized tools or keys. As such, the general purpose of the present invention, which will be described subsequently in greater detail, is to provide a new and improved quick release window and door guard which has all the advantages of the prior art quick release window and door guards and none of the disadvantages.

To attain this, the present invention essentially comprises a metallic grill formed from a plurality of cross-extending welded bars, with this grill being hingedly positionable across a window or door opening. The grill includes a lock engaging mechanism which is positionable next to a spring-biased lock assembly attachable to an interior frame portion of the door or window. The lock assembly includes a pair of bolts engagable with a lock engaging plate forming a part of the grill, and these bolts are held in engagement with apertures in the grill plate by helical springs retained within the mechanism. A manually removable pin can be pulled out of the lock mechanism to thus permit reciprocal movement of the locking bars, and a ring member may then be grasped to effect a reciprocal movement of the bars to thereby release the grill for swinging movement upon its hinges.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved quick release building opening guard which has all the advantages of the prior art quick release building opening guards and none of the disadvantages.

It is another object of the present invention to provide a new and improved quick release building opening guard which may be easily and efficiently manufactured and marketed.

It is a further object of the present invention to provide a new and improved quick release building opening guard which is of a durable and reliable construction.

An even further object of the present invention is to provide a new and improved quick release building opening guard which is susceptible of a low cost of manufacture with regard to both materials and labor, and which accordingly is then susceptible of low prices of sale to the consuming public, thereby making such quick release building opening guards economically available to the buying public.

Still yet another object of the present invention is to provide a new and improved quick release building opening guard which provides in the apparatuses and methods of the prior art some of the advantages thereof, while simultaneously overcoming some of the disadvantages normally associated therewith.

Still another object of the present invention is to provide a new and improved quick release building opening guard which may be manually released without the need for or use of specialized keys or tools.

Yet another object of the present invention is to provide a new and improved quick release building opening guard which permits an individual to exit the building through the opening in a rapid manner during an emergency situation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
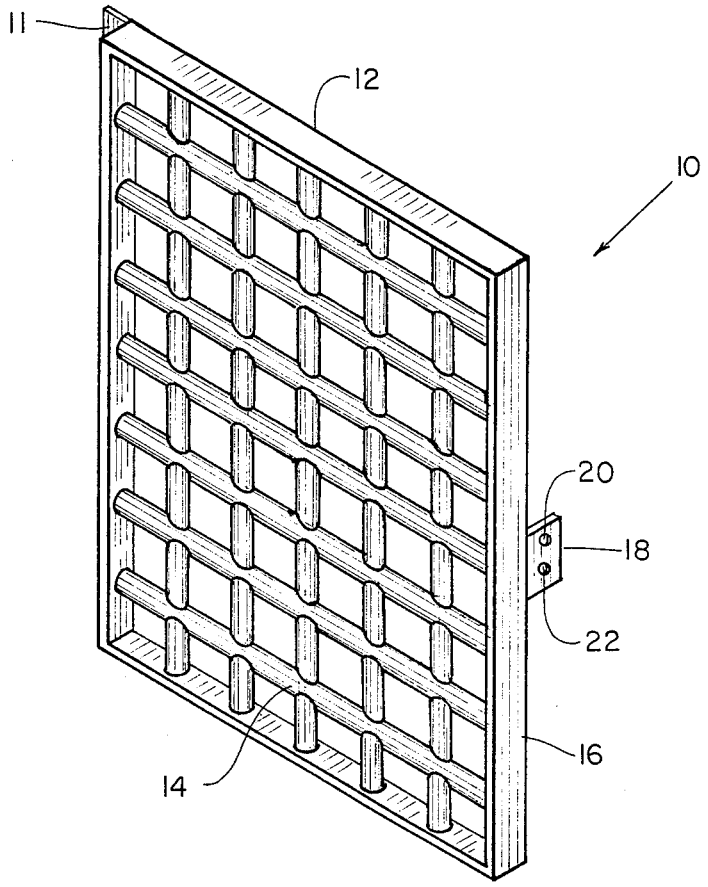
FIG. 1 is a perspective view of a typical building opening covering grate forming a part of the present invention.
Figure 2:
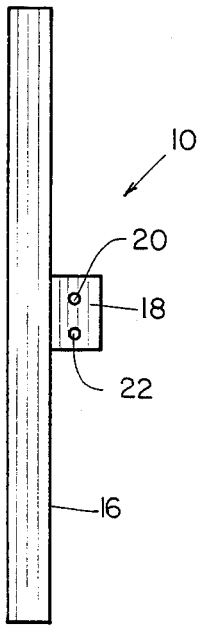
FIG. 2 is an end elevation view of the grate.

With reference now to the drawings, and in particular to FIGS. 1 and 2 thereof, a new and improved quick release window or door guard embodying the principles and concepts of the present invention and generally designated by the reference numeral 10 will be described.

More specifically, it will be noted that the guard 10 essentially includes a metallic grate 12 which may be shaped and sized to fit over virtually any type of window or door opening. The grate 12 may be rectangularly shaped and can include a plurality of cross-extending metallic bars 14 welded or otherwise fastened together to form a grid pattern. The periphery of the grate 12 may be formed by sections of flat iron 16, and an appropriate unillustrated hinge assembly may be fastened to one side of the grate. Additionally, a locking plate 18 may be welded to a peripheral portion of the grate 12, and such locking plate should include a pair of through-extending apertures 20, 22.

Figure 3:
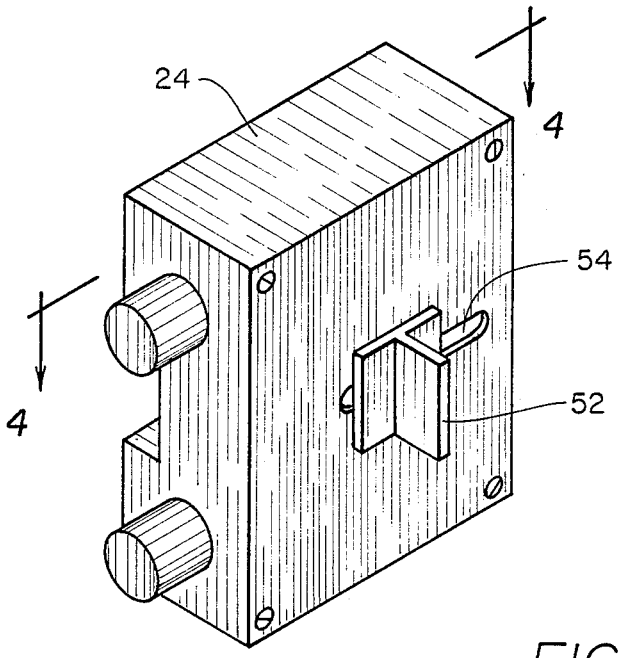
FIG. 3 is a perspective view of the lock mechanism forming a part of the present invention.
Figure 4:
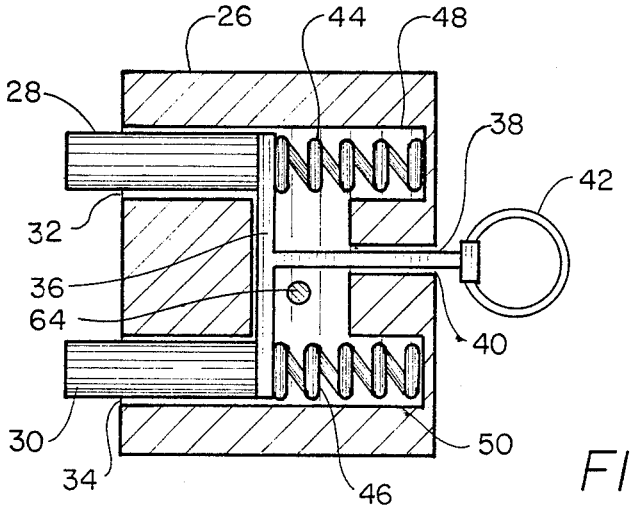
FIG. 4 is a front elevation view, partly in cross section, illustrating the internal parts of the lock mechanism.

As illustrated in FIGS. 3 and 4, a lock mechanism 24 comprises a further part of the invention and is selectively mounted along a peripheral frame portion of the chosen door or window so as to be engagable with the locking plate 18. The locking mechanism 24 includes a rectangularly shaped housing 26. A pair of locking bars 28, 30 are slidably disposed in respective apertures 32, 34 formed in the housing 26, and the locking bars are attached together by a T-shaped member 36 retained within the housing 26. In this regard, the locking bars, 28, 30 are attached to opposed ends of two arms of the member 36, with a third arm 38 extending through an aperture 40 formed in a rear portion of the housing. The arm 38 includes a grasping ring 42 and is slidably movable within the aperture 40. A pair of helical springs 44, 46 are compressibly retained within the housing 26 within respective slots 48, 50. The springs 44, 46 abut against opposed ends of the member 36 and serve to force the locking bars 28, 30 outwardly from the housing 26. A manually removable locking pin 52 may be inserted into the housing 26 through a slot 54 formed therein, and such locking pin includes an extended arm portion 64 which serves to prevent movement of the locking bars 28, 30 when the pin is positioned within the slot.

As to the manner of usage and operation of the present invention, it can be appreciated that the grate 12 may be hingedly mounted over a window or door opening, and the locking mechanism 24 may be mounted around a peripheral edge of the window or door opening so as to be engagable with the locking plate 18. Under normal conditions, the locking bars 28, 30 will be respectively retained within the apertures 20, 22 so as to prevent a removal of the grate 12 from the window or door opening from an exterior position relative to the window or door. While not being openable from an exterior portion of a building, the grate 12 may be hingedly removed from the window or door opening from an interior portion of the building. In this regard, a user need only to manually remove the locking pin 52, and then by grasping the ring 42, he can slidably move the locking bars 28, 30 out of engagement with the apertures 20, 22, thereby to allow a hinged opening of the grate 12. As such, a quick release of the grate 12 is provided for in a situation of an emergency nature.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved quick release guard assembly positionable over a door or window opening in a building, said quick release guard assembly including:

grate means hingedly positionable over said opening; said grate means defining a perimeter including a plurality of surfaces, and lock plate means forming a part of said grate means; said lock plate means comprises a single plate member offset and integrally secured medially of one of said surfaces, and locking mechanism means attachable to a peripheral portion of said opening, said locking mechanism means being lockably engageable with said lock plate means, thereby to prevent a hinged movement of said grate means away from said opening; said locking mechanism including a single housing with a plurality of spring biased locking bar means secured within said housing mounted for reciprocation within said housing, and quick release means forming a part of said locking mechanism means, said quick release means being manually operable to effect an unlocking of said locking mechanism means from said grate means; and said quick release means includes a reciprocally movable rigid arm integrally secured to said locking bar means and extending outwardly of said housing parallel to said reciprocation, and quick release means prevention means for selectively preventing actuation of said quick release means.

2. The new and improved quick release guard assembly positionable over a door or window opening in a building as described in claim 1, wherein said quick release means prevention means including a locking pin selectively positionable within said locking mechanism means, said locking pin preventing reciprocal movement of said locking bar means.

* * * * *